US009084480B2

(12) United States Patent
Atwood

(10) Patent No.: US 9,084,480 B2
(45) Date of Patent: Jul. 21, 2015

(54) STORAGE AND TRANSPORT CASE FOR JEWELRY AND ACCESSORIES

(71) Applicant: Erin L. Atwood, Atlanta, GA (US)

(72) Inventor: Erin L. Atwood, Atlanta, GA (US)

( * ) Notice: Subject to any disclaimer, the term of this patent is extended or adjusted under 35 U.S.C. 154(b) by 0 days.

(21) Appl. No.: 14/042,781

(22) Filed: Oct. 1, 2013

(65) Prior Publication Data

US 2014/0091691 A1 Apr. 3, 2014

Related U.S. Application Data

(60) Provisional application No. 61/708,156, filed on Oct. 1, 2012.

(51) Int. Cl.

| | |
|---|---|
| ***A47B 87/00*** | (2006.01) |
| ***A47B 47/04*** | (2006.01) |
| ***A45C 11/16*** | (2006.01) |

(52) U.S. Cl.

CPC ..... *A47B 47/042* (2013.01); *A45C 11/16* (2013.01)

(58) Field of Classification Search

CPC ..... A47B 87/00; A47B 49/00; A47B 53/02; A47B 31/04; A01K 97/06

USPC ..... 312/107, 108, 111, 198, 199, 200, 202, 312/249.8, 249.13, 249.7, 205; 206/6.1

See application file for complete search history.

(56) References Cited

U.S. PATENT DOCUMENTS

| | | | | | |
|---|---|---|---|---|---|
| 251,337 | A | * | 12/1881 | Burrows | 312/232 |
| 260,703 | A | * | 7/1882 | Moore et al. | 312/200 |
| 432,096 | A | * | 7/1890 | Thomas | 312/200 |
| 1,377,824 | A | * | 5/1921 | Forbes | 62/326 |
| 1,589,218 | A | * | 6/1926 | Pinten | 206/742 |
| 1,632,476 | A | * | 6/1927 | Holderman et al. | 312/199 |
| 2,087,863 | A | * | 7/1937 | Sharp | 352/242 |
| D158,825 | S | * | 5/1950 | Winter | D6/447 |
| 2,804,226 | A | * | 8/1957 | Freedman | 217/8 |
| 2,852,172 | A | * | 9/1958 | Brown | 223/106 |
| 2,875,010 | A | * | 2/1959 | Sola et al. | 312/200 |
| 3,055,723 | A | * | 9/1962 | Hildebrand, Sr. | 312/200 |
| 3,070,416 | A | * | 12/1962 | Post | 312/241 |
| 3,202,469 | A | * | 8/1965 | Lawe | 312/200 |
| 3,257,154 | A | * | 6/1966 | Lewis | 312/198 |
| 3,330,608 | A | * | 7/1967 | Druger, Jr. | 312/111 |
| 3,512,857 | A | * | 5/1970 | Butera | 312/107 |
| 3,596,297 | A | * | 8/1971 | James | 5/2.1 |
| 3,905,662 | A | * | 9/1975 | Richmond | 312/249.8 |
| 4,471,586 | A | * | 9/1984 | Shuch et al. | 52/36.2 |
| 5,069,332 | A | * | 12/1991 | Williams et al. | 206/6.1 |
| D372,607 | S | * | 8/1996 | Pallas | D6/445 |
| 6,026,951 | A | * | 2/2000 | Ovadia et al. | 206/6.1 |

(Continued)

*Primary Examiner* — Janet M Wilkens

(74) *Attorney, Agent, or Firm* — Sutherland Asbill & Brennan LLP

(57) ABSTRACT

A storage and transport case for jewelry and accessories is provided. The case may include a base having a number of panels and a top removably attached to an upper portion of the base. The number of panels may be movable from a transport configuration to a display configuration. The number of panels further may be pivotally connected to one another in series along lateral edges. Each of the panels may include one or more compartments for storing jewelry or accessories. Each of the compartments may be able to store and protect a specific type of jewelry or accessory such as earrings bracelets belts rings necklaces sunglasses hair accessories hats watches handbags and scarves. The compartments may be inaccessible when the number of panels is in the transport configuration and the compartments may be accessible when the number of panels is in the display configuration.

19 Claims, 7 Drawing Sheets

(56) References Cited

U.S. PATENT DOCUMENTS

| | | | | |
|---|---|---|---|---|
| D440,429 | S * | 4/2001 | Wales et al. | D6/446 |
| 6,375,285 | B1 * | 4/2002 | Choi | 312/202 |
| 7,866,769 | B2 * | 1/2011 | Ahlgrim et al. | 312/108 |
| D655,947 | S * | 3/2012 | Doane | D6/470 |
| 8,162,415 | B2 * | 4/2012 | Hagele et al. | 312/198 |
| D712,687 | S * | 9/2014 | Arie et al. | D6/663 |
| 2002/0096845 | A1 * | 7/2002 | Spann | 280/79.2 |
| 2003/0146678 | A1 * | 8/2003 | Greiner | 312/107 |
| 2004/0119382 | A1 * | 6/2004 | Dettmann | 312/198 |
| 2007/0252489 | A1 * | 11/2007 | Schulz et al. | 312/7.2 |
| 2011/0253494 | A1 * | 10/2011 | Coventry | 190/110 |
| 2013/0055906 | A1 * | 3/2013 | Kanbur et al. | 99/419 |

* cited by examiner

STORAGE AND TRANSPORT CASE FOR JEWELRY AND ACCESSORIES

FIELD OF THE DISCLOSURE

The present application relates generally to storage devices and more particularly to a storage and transport case for jewelry and accessories.

BACKGROUND OF THE DISCLOSURE

Various devices are known for storing different types of jewelry and personal accessories. For example, jewelry boxes are commonly used for organizing and storing a collection of jewelry, which may include necklaces, bracelets, rings, earrings, and other similar items. Alternatively, jewelry items may be organized and stored on a tree-style stand, which allows for easy viewing of the jewelry collection and selection of items. However, jewelry boxes and stands may not accommodate other personal accessories, such as watches, sunglasses, hats, belts, scarves, handbags, and hair accessories. Accordingly, these items are often stored elsewhere, such as in a closet or armoire, on a counter, in a furniture drawer, or on wall hooks. As a result, a person must access various storage locations in order to view and select the different pieces of jewelry and personal accessories that he or she will wear on a given day. Furthermore, because many of the above-mentioned storage devices are not easily portable, it is often difficult for the person to transport all or some of his or her jewelry and personal accessories from one location to another.

Various other devices are known for transporting different types of jewelry and personal accessories. Traditional pieces of luggage may accommodate certain jewelry or accessories, but such luggage may lack structure or features for properly organizing, protecting, and displaying the stored items. For example, a jewelry pouch or bag may be used to contain a limited number of jewelry items for travel. However, such devices are often too small to contain an entire jewelry collection or even a variety of jewelry sufficient for a long trip. Additionally, due to the compact nature of a jewelry pouch or bag, it is often difficult for a person to view the contents stored inside and to select which jewelry items to wear. Furthermore, known jewelry pouches and bags often do not keep the items of jewelry separate, and thus items may become damaged or tangled with one another. Moreover, jewelry pouches and bags may be too small to contain other personal accessories, such as watches, sunglasses, hats, belts, scarves, handbags, and hair accessories. Accordingly, such accessories are often transported in other forms of containers or luggage. For example, watches and sunglasses may be stored in individual cases, hats may be transported in traditional hat boxes, and belts may be stored in luggage bags along with clothing. As a result, when a person needs to transport his or her jewelry and personal accessories, several different containers or pieces of luggage may be required. Additionally, after the containers or luggage are moved to a desired location, viewing and accessing the jewelry and accessories may be cumbersome, discombobulating, and time-consuming.

Accordingly, there is a desire for a storage and transport case for containing an entire collection of jewelry and personal accessories. Such a case should include various compartments for storing different types of jewelry, such as necklaces, bracelets, watches, rings, and earrings, as well as different types of accessories, such as sunglasses, hats, belts, scarves, handbags, and hair accessories. The compartments should provide various features for organizing and displaying the stored items and also should provide various features for protecting the jewelry and accessories from damage or tangling during transport. Such a case should be compact and easily moved from one place to another, yet the case should allow a person to easily view the stored items and remove certain items for use. Furthermore, such a case should include these features and functionality while providing a visually aesthetic presentation of its contents.

SUMMARY OF THE DISCLOSURE

The present application provides a storage and transport case for jewelry and accessories. The case may include a base having a number of panels, and a removable top attached to an upper portion of the base. The number of panels may be movable from a transport configuration to a display configuration. The number of panels further may be pivotally connected to one another in series along lateral edges. Each of the panels may include one or more compartments for storing jewelry or accessories. Specifically, one of the panels may include an earrings compartment, a bracelets compartment, a belts compartment, a rings compartment, a necklaces compartment, a sunglasses compartment, a hair accessories compartment, a hats compartment, a watches compartment, a handbags compartment, a scarves compartment, and a travel case compartment. The compartments may be inaccessible when the number of panels is in the transport configuration, and the compartments may be accessible when the number of panels is in the display configuration. These and other features and aspects of the present application will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings. The use of the same reference numerals indicates similar or identical items. Various embodiments may utilize elements, components, and/or configurations other than those illustrated in the drawings, and some elements, components, and/or configurations may not be present in various embodiments. Throughout this disclosure, depending on the context, singular and plural terminology may be used interchangeably.

DETAILED DESCRIPTION OF THE DISCLOSURE

The present disclosure includes various examples of storage and transport cases for jewelry and accessories. According to certain aspects, the disclosed examples may address one or more of the above-mentioned desires. Therefore, the case may be able to contain an entire collection of jewelry and personal accessories. Specifically, the case may include various specialized compartments for storing different types of jewelry, such as necklaces, bracelets, rings, and earrings, as well as different types of accessories, such as watches, sunglasses, hats, belts, scarves, handbags, and hair accessories. The compartments may include various features for organizing and displaying the stored items and also may include various features for protecting the jewelry and accessories from damage or tangling during transport. Further, the case may be positioned in a compact manner and may include features such that the case may be transported easily from one location to another. The case also may be positioned in an open manner and may include features such that the stored jewelry and accessories may be viewed and removed easily for use. Accordingly, the disclosed examples may provide significant advantages over known storage devices and transport devices for jewelry and accessories.

Figure 2:
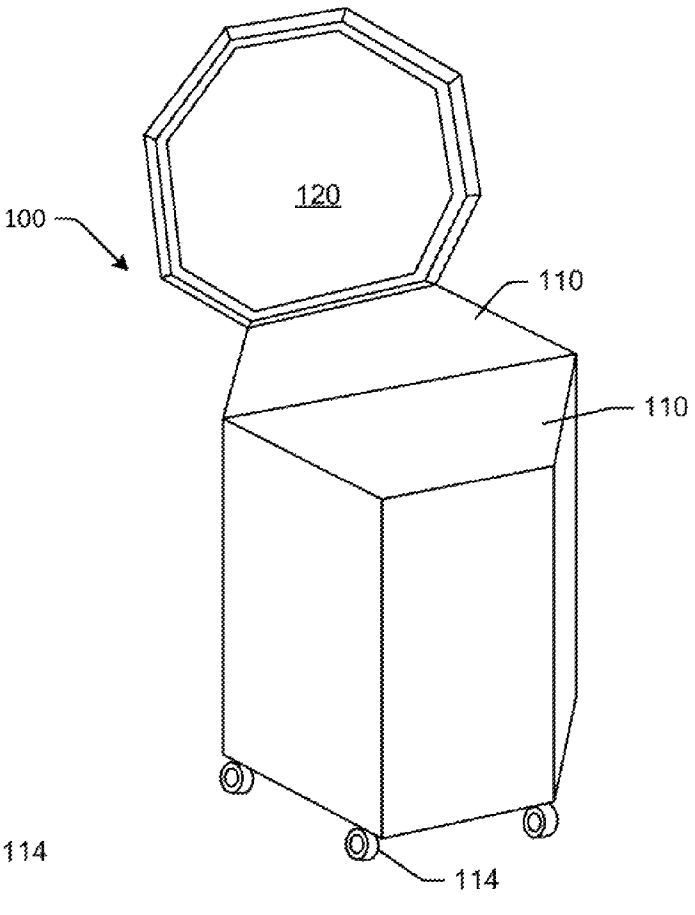
FIG. 2 depicts a perspective view of an example storage and transport case as may be described in the present application, wherein the case is shown in a transport configuration with a removable top removed from view.
Figure 1:
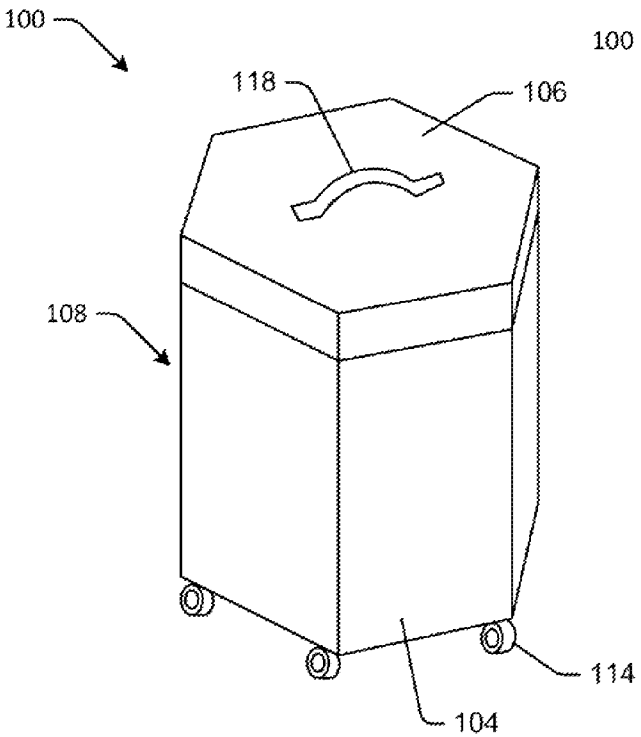
FIG. 1 depicts a perspective view of an example storage and transport case as may be described in the present application, wherein the case is shown in a transport configuration.
Figure 3:
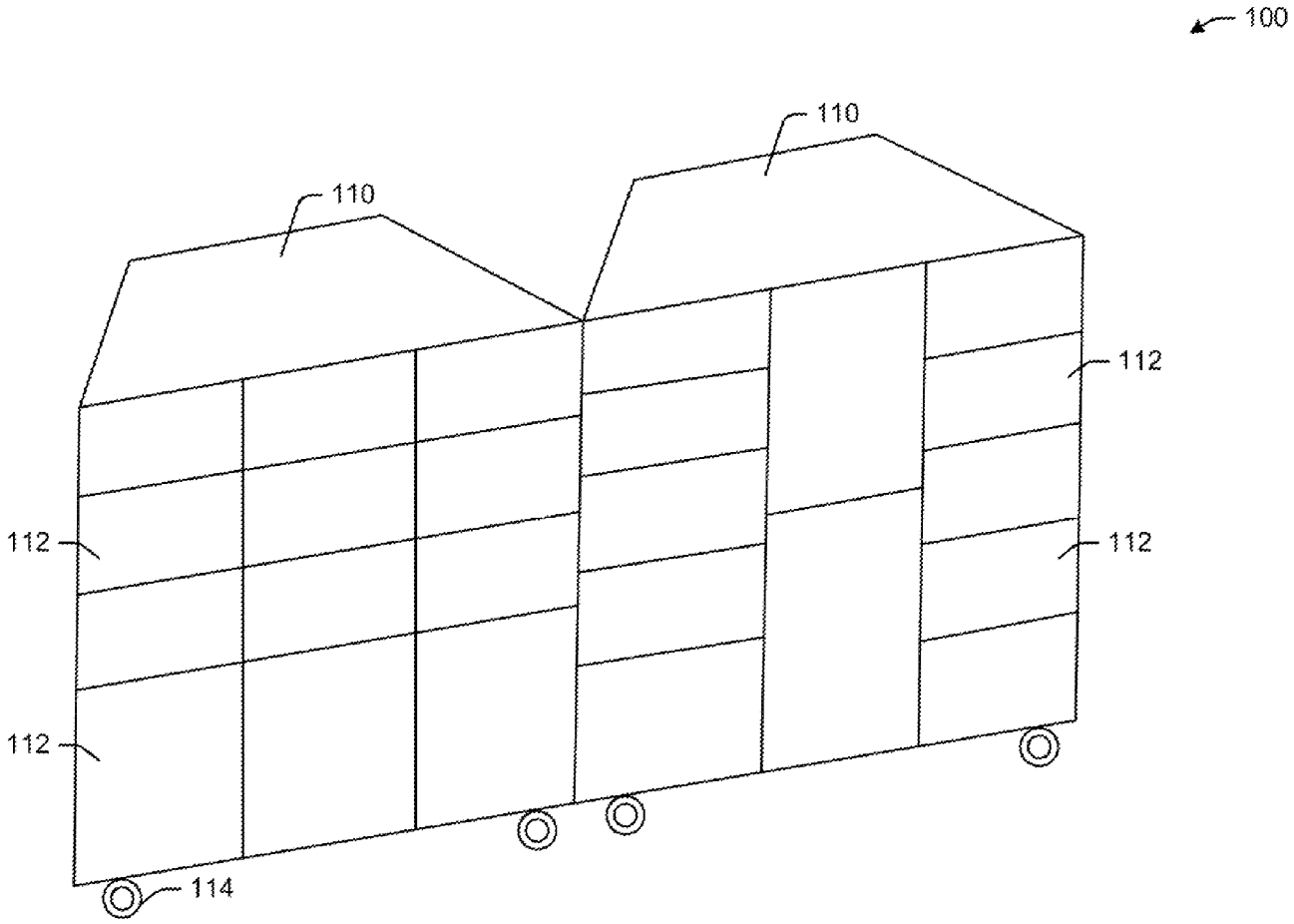
FIG. 3 depicts a perspective view of the example storage and transport case of FIG. 2, wherein the case is shown in a display configuration.
Figure 4:
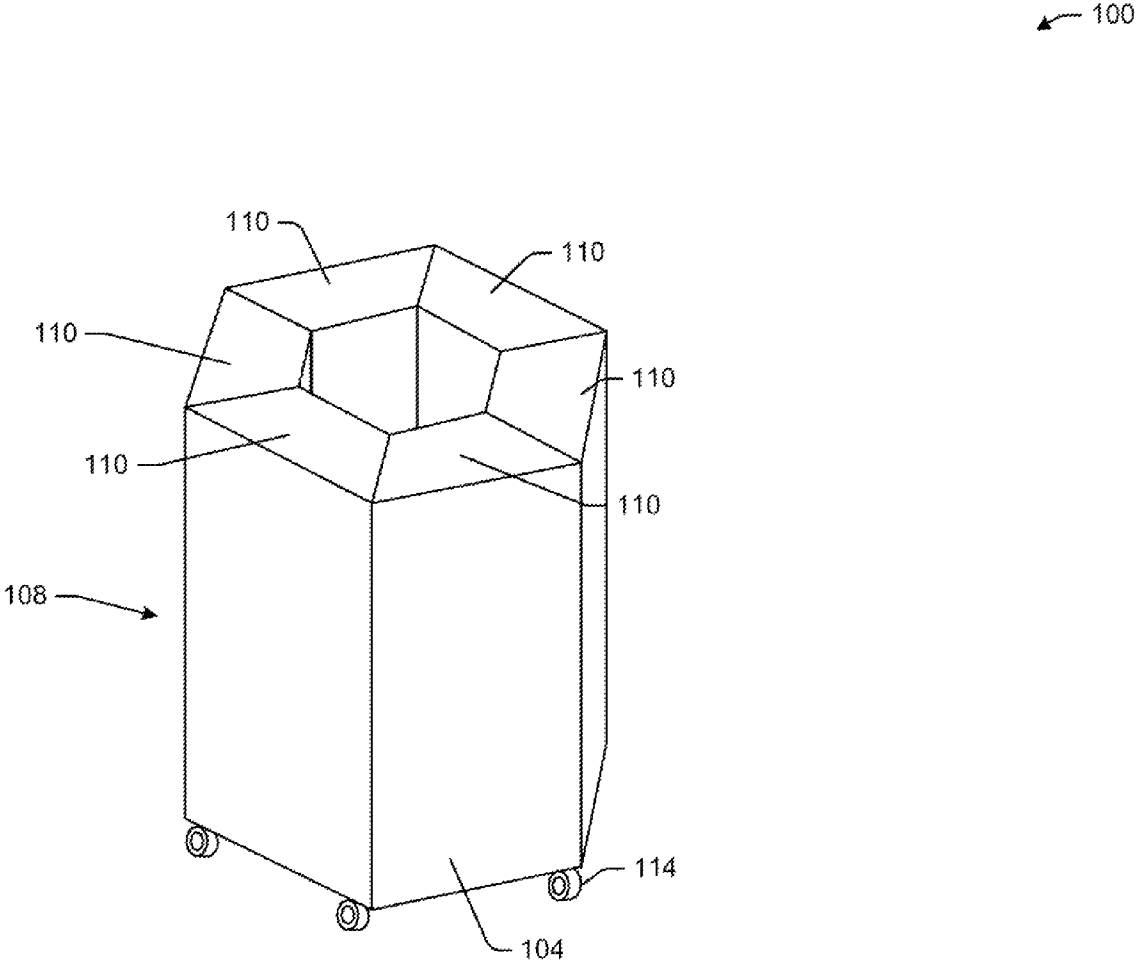
FIG. 4 depicts a perspective view of an example storage and transport case as may be described in the present application, wherein the case is shown in a transport configuration with a removable top removed from view.
Figure 5:
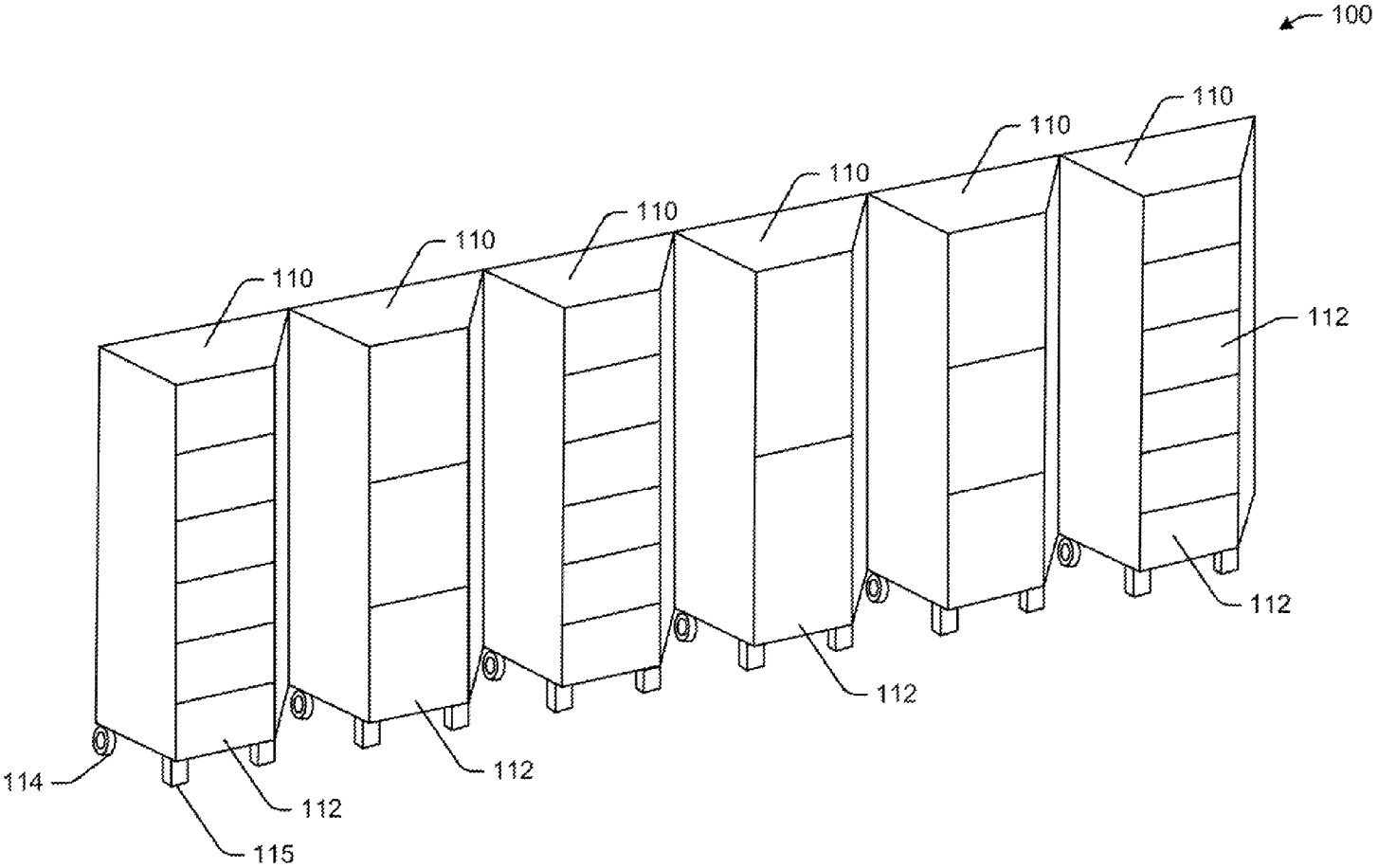
FIG. 5 depicts a perspective view of the example storage and transport case of FIG. 4, wherein the case is shown in a display configuration.

Referring now to the drawings, in which like numerals refer to like elements throughout the several views, FIGS. 1-11 depict various views of a storage and transport case 100 in accordance with an example of the disclosure. Specifically, FIG. 1 depicts a perspective view of the storage and transport case 100 in a transport configuration, FIG. 2 depicts a perspective view of the storage and transport case 100 in a transport configuration with a removable top removed from view, FIG. 3 depicts a perspective view of the storage and transport case 100 in a display configuration, FIG. 4 depicts a storage and transport case 100 in a transport configuration with a removable top removed from view, and FIG. 5 depicts the storage and transport case in a display configuration. FIGS. 6-11 depict front views of different panels of the storage and transport case 100.

Collectively referring to FIGS. 1-5, and by way of example, the storage and transport case 100 may include a base 104 and a removable top 106. The case 100 may have a generally polygonal shape, and more specifically the case 100 may have a generally regular polygonal shape. For example, as shown in FIG. 1, the case may have a regular hexagonal shape such that each of the base 104 and the removable top 106 may include six sides 108. However, it will be understood that the case 100 may have other shapes and that the base 104 and the top 106 may have any number of sides 108. The top 106 may be removably attached to a top end of the base 104. For example, the top 106 may be removably attached to the base by any number of fasteners, such as magnets, locks, buckles, clasps, hooks, or other known fastening devices. The fasteners may be mounted internally such that they are not visible when the top 106 is attached to the base 104. Alternatively, the fasteners may be mounted externally for ease of access and use, or for aesthetic purposes. In certain aspects, as shown in FIG. 2, the top 106 may be pivotally attached to one side 108 of the base 104 by a hinge. Accordingly, the top 106 may be removed from the top end of the base 104 while remaining attached to the side 108 of the base for convenience and additional functionality as will be described below.

The base 104 may include a number of panels 110 each of which extends vertically from the bottom of the base 104 to the top of the base 104. Each of the panels 110 may include a closed top surface such that the top surfaces of the panels 110 form a top surface of the base. Further, each of the panels 110 may include a bottom surface such that the bottom surfaces of the panels 110 form a bottom surface of the base. Each of the panels 110 also may include a number of compartments 112 accessible from an interior side of the panel 110. Each of the compartments 112 may be configured for storing and displaying various types of jewelry and personal accessories, as will be described in detail below. Each of the panels 110 further may include one or more wheels 114 mounted to the bottom surface of each of the panels. The wheels 114 may enable the case 100 to be transported easily by rolling. The wheels 114 may be configured to roll in any direction, allowing the case 100 to be positioned easily along a floor or other surface. The wheels 114 further may be configured to lock such that the case 100 may be stabilized at a certain position or maintained in a certain configuration. Each of the panels 110 also may include one or more drop-down legs 115 mounted to the bottom surface of each of the panels. The legs 115 may be configured to drop down to provide additional support of the panels 110 when desired. Additionally, the legs 115 may be configured to be stored underneath the panels 110 when they are not in use.

Each of the panels 110 may be pivotally connected to one or more of the other panels 110. Specifically, adjacent panels 110 may be pivotally connected along adjacent edges 116 extending from the bottom surface of the base 104 to the top surface of the base 104. The pivotal connection may be provided by one or more hinges mounted to each of the adjacent panels. The hinges may be conventional metal hinges, flexible fabric hinges, malleable plastic hinges, or other known hinge devices. The hinges may be mounted internally with respect to the base 104. In other words, the hinges may be mounted to the adjacent panels 110 such that the hinges do not extend beyond the sides 108 of the base 104 and thus are not visible from the outside of the base 104. Alternatively, the hinges may be mounted externally for aesthetic purposes.

In certain aspects, as shown in FIGS. 2 and 3, the base 104 may include two panels 110 pivotally connected along adjacent edges 116. Accordingly, the two panels 110 are movable relative to one another from a transport configuration, as shown in FIG. 2, to a display configuration, as shown in FIG. 3. In such aspects, the base 104 may further include any number of fasteners for preventing the two panels 110 from freely pivoting relative to one another. The fasteners may include magnets, locks, buckles, clasps, hooks, malleable plastic connections, or other known fastening devices. The fasteners may be mounted on the panels 110 about the non-pivoting side of the panels 110. Accordingly, the fasteners may serve to maintain the panels 110 in the transport configuration, particularly during transport of the case 100. The fasteners may be mounted internally with respect to the base 104, yet they may be accessible from the outside of the base 104 for release. Alternatively, the fasteners may be mounted externally with respect to the base 104 for ease of access and use, or for aesthetic purposes.

In other aspects, as shown in FIGS. 4 and 5, the base 104 may include six panels 110 pivotally connected to one another in series. In other words, the base 104 may include four intermediate panels 110 each of which is pivotally connected to two other panels 110, and also may include two end panels 110 each of which is pivotally connected to one other panel 110. Accordingly, the six panels 110 are movable relative to one another from a storage configuration, as shown in FIG. 4, to a display configuration, as shown in FIG. 5. In such aspects, the base 104 may further include any number of fasteners for preventing the two end panels 110 from freely pivoting relative to one another. The fasteners may include magnets, locks, buckles, clasps, hooks, malleable plastic connections, or other known fastening devices. The fasteners may be mounted on the end panels 110 about the non-pivoting side of the end panels 110. Accordingly, the fasteners may serve to maintain the panels 110 in the transport configuration, particularly during transport of the case 100. The fasteners may be mounted internally with respect to the base 104, yet they may be accessible from the outside of the base 104 for release. Alternatively, the fasteners may be mounted externally with respect to the base 104 for ease of access and use, or for aesthetic purposes. It will be understood that the base 104 may have a configuration of panels 110 other than those described above. In other words, the base 104 may include any number of panels 110, and the panels 110 may be pivotally connected or separable in various ways.

As shown in FIG. 1, the removable top 106 may cover the top surface of the base 104 when the case 100 is in the transport configuration. In certain aspects, the top 106 may extend downward and cover upper portions of the panels 110, which may maintain the panels 110 in the transport configuration. In such aspects, the base 104 may not include fasteners to maintain the panels 110 in the storage configuration because such fasteners may be redundant. The top 106 may include a handle 118 mounted on an outer surface of the top 106, which may assist in transport of the case 100. The handle 118 may be a fixed handle, a pivoting handle, an extending handle, or one of other known handle types. In certain aspects, the top 106 may include a mirror 120 positioned on an inner surface of the top 104. Accordingly, when the top 106 is removed from the base 104, the mirror may be positioned for use. In certain aspects where the top 106 is detachable from the base 104, the mirror 120 may be used separately from the base 104. In this manner, due to the polygonal shape of the top 106, the top 106 may be placed with one of the polygonal sides face down on a table or other surface such that the mirror 120 is in an upright position for use. In other aspects where the top 106 is pivotally attached to one side 108 of the base 104 by a hinge, the mirror 120 may be used in conjunction with the base 104. In this manner, the top 106 may be pivoted such that the mirror 120 is in an upright or angled position for use. In such aspects, the hinged connection between the top 106 and the base 104 may be configured to limit the pivoting range of motion such that the top 106 cannot pivot beyond the upright or angled position for use.

Figure 6:
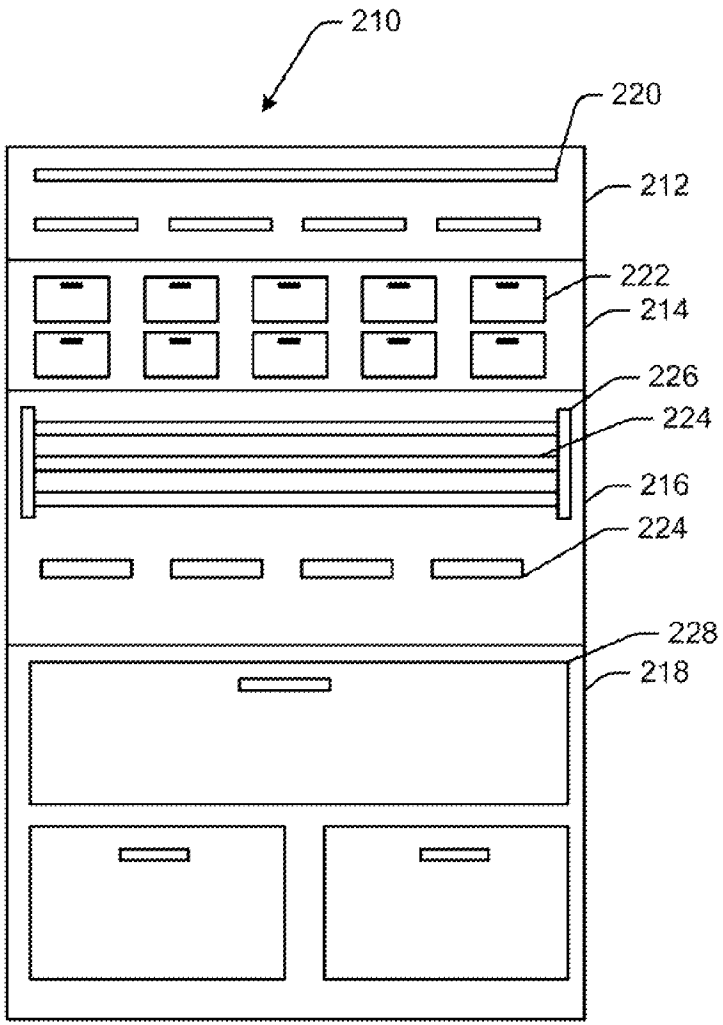
FIG. 6 depicts a front view of a first panel of an example storage and transport case as may be described in the present application.

FIG. 6 shows a first panel 210 of the storage and transport case 100. The first panel 210 may include an earrings compartment 212, a rings compartment 214, a bracelets compartment 216, and a belts compartment 218. The earrings compartment 212 may be able to store, display, and protect various types of earrings Inner surfaces of the earrings compartment 212 may be lined with a soft or cushioning material to protect the earrings, particularly during transport. In certain aspects, the earrings compartment 212 may include one or more drawers for stud-style earrings or other smaller-sized earrings. The drawers may slide outward from the panel 210, or the drawers may pivot outward from the panel 210 about an edge of the drawers. The drawers may be configured to slide out of the panel 210 completely, or the drawers may be configured to have a limited range of sliding motion. For example, the drawers may be configured to slide out of the panel 210 completely so that they may be incorporated into a smaller travel case, as will be described in detail below. Additionally, the drawers may contain one or more trays configured to be removed from the drawers. For example, a drawer may contain multiple trays stacked on top of each other such that one tray may be lifted up and out of the drawer for access to another tray below. The interior of each drawer or tray may include a single section for storing a single earring or a single pair of earrings within the section. Alternatively, the interior of each drawer or tray may include a number of sections for storing a single earring or a single pair of earrings within each section. The drawers or trays may be lined internally with a soft or cushioning material to protect the earrings, particularly during transport. For example, the drawers or trays may be lined with a felt, a foam, or other similar material. Additionally, each of the sections may include a pillowed surface having a recess for securely receiving an earring or pair of earrings. Such a configuration would prevent movement of the earrings during transport of the case 100. In some aspects, the earrings compartment 212 may include one or more earring storage beams 220 for hanging-style earrings that include hooks. The storage beams 220 may extend horizontally within the earrings compartment 212, and the hooks of various earrings may be placed over the storage beams 220 such that the earrings hang naturally from the storage beams. Each of the storage beams 220 may extend the entire width of the earrings compartment 212, and each of the storage beams 220 may include dividing elements for keeping adjacent earrings separate from one another. Alternatively, each of the storage beams 220 may be sized to hold a single pair of earrings, and thus several storage beams 220 may be aligned along the width of the earrings compartment. In other aspects, the earrings compartment 212 may include additional or alternative features for storing, displaying, and protecting various types of earrings.

The rings compartment 214 may be able to store, display, and protect various types of rings. Inner surfaces of the rings compartment 214 may be lined with a soft or cushioning material to protect the rings, particularly during transport. In certain aspects, the rings compartment 214 may include one or more drawers 222. The drawers 222 may slide outward from the panel 210, or the drawers 222 may pivot outward from the panel 210 about an edge of the drawers 222. The drawers 222 may be configured to slide out of the panel 210 completely, or the drawers 222 may be configured to have a limited range of sliding motion. For example, the drawers 222 may be configured to slide out of the panel 210 completely so that they may be incorporated into a smaller travel case, as will be described in detail below. Additionally, the drawers 222 may contain one or more trays configured to be removed from the drawers 222. For example, a drawer 222 may contain multiple trays stacked on top of each other such that one tray may be lifted up and out of the drawer 222 for access to another tray below. The interior of each drawer 222 or tray may include a single section for storing a single ring or multiple rings within the section. Alternatively, the interior of each drawer 222 or tray may include a number of sections for storing a single ring or multiple rings within each section. The drawers 222 or trays may be lined internally with a soft or cushioning material, such as a felt, a foam, or other similar material, to protect the rings, particularly during transport. Additionally, each of the sections may include a pillowed surface having a recess for securely receiving at least one ring. Such a configuration would prevent movement of the rings during transport. In other aspects, the rings compartment 214 may include one or more ring storage beams for retaining rings. The storage beams may extend horizontally within the rings compartment 214, and rings may be placed over the storage beams such that the rings hang naturally from the storage beams. Each of the storage beams may extend the entire width of the rings compartment 214, and each of the storage beams may include dividing elements for keeping adjacent rings separate from one another. Alternatively, each of the storage beams may be sized to hold a single ring, and thus several storage beams may be aligned along the width of the rings compartment 214. In some aspects, a storage beam may be pivotally connected to one inner surface of the rings compartment 214 at one end and releaseably connected to another inner surface of the rings compartment 214 at the other end. Accordingly, the other end of the storage beam may be pivoted outward to allow a ring to be slid onto the storage beam for secure retention. In certain aspects, the rings compartment 214 may include hooks, posts, or clasps mounted on one or more surfaces within the rings compartment 214. Such features may be positioned and oriented such that a finger hole of a ring may be placed onto and retained by a portion of a hook, post, or clasp. In other words, the features may be such that the ring is retained on the hook, post, or clasp, by gravity or by additional retention features, even during transport of the case 100. In certain other aspects, the rings compartment 214 may include additional or alternative features for storing, displaying, and protecting various types of rings.

The bracelets compartment 216 may be able to store, display, and protect various types of bracelets Inner surfaces of the bracelets compartment 216 may be lined with a soft or cushioning material to protect the bracelets, particularly during transport. In certain aspects, the bracelets compartment 216 may include one or more bracelet storage beams 224 for retaining certain types of bracelets. The storage beams 224 may extend horizontally within the bracelets compartment 216, and bracelets may be placed over the storage beams 224 such that the bracelets hang naturally from the storage beams. Each of the storage beams 224 may extend the entire width of the bracelets compartment 216, and each of the storage beams 224 may include dividing elements for keeping adjacent bracelets separate from one another. Alternatively, each of the storage beams 224 may be sized to hold a single bracelet, and thus several storage beams 224 may be aligned along the width of the earrings compartment. In certain aspects, a storage beam 224 may be fixed to inner surfaces of the bracelets compartment 216 at each end, which would allow for bracelets having releasable clasps to be placed over the storage beam 224 and then clasped for secure retention. In other aspects, a storage beam 224 may be pivotally connected to one inner surface of the bracelets compartment 216 at one end and releaseably connected to another inner surface of the bracelets compartment 216 at the other end. Accordingly, the other end of the storage beam 224 may be pivoted outward to allow a non-clasped or solid bangle-style bracelet to be slid onto the storage beam 224 for secure retention. In certain aspects, the bracelets compartment may include an array 226 of storage beams 224 configured to rotate in a Ferris-wheel type manner. Accordingly, the array 226 of storage beams 224 may be rotated to bring one of the storage beams 224 to the front of the compartment 216 for access. In this manner, the array 226 of storage beams 224 may store numerous bracelets in a compact configuration while allowing for ease of access to the bracelets. In some aspects, the bracelets compartment 216 may include one or more drawers. The drawers may slide outward from the panel 210, or the drawers may pivot outward from the panel 210 about an edge of the drawers. The drawers may be configured to slide out of the panel 210 completely, or the drawers may be configured to have a limited range of sliding motion. For example, the drawers may be configured to slide out of the panel 210 completely so that they may be incorporated into a smaller travel case, as will be described in detail below. Additionally, the drawers may contain one or more trays configured to be removed from the drawers. For example, a drawer may contain multiple trays stacked on top of each other such that one tray may be lifted up and out of the drawer for access to another tray below. The interior of each drawer or tray may include a single section for storing a single bracelet or multiple bracelets within the section. Alternatively, the interior of each drawer or tray may include a number of sections for storing a single bracelet or multiple bracelets within each section. The drawers or trays may be lined internally with a soft or cushioning material, such as a felt, a foam, or other similar material, to protect the bracelets, particularly during transport. Additionally, each of the sections may include a contoured surface having a recess for securely receiving at least one bracelet. Such a configuration would prevent movement of the bracelets during transport. In certain other aspects, the bracelets compartment 216 may include additional or alternative features for storing, displaying, and protecting various types of bracelets.

The belts compartment 218 may be able to store, display, and protect various types of belts Inner surfaces of the belts compartment 218 may be lined with a soft or cushioning material to protect the belts, particularly during transport. In certain aspects, the belts compartment 218 may include one or more drawers 228. The drawers 228 may slide outward from the panel 210, or the drawers 228 may pivot outward from the panel 210 about an edge of the drawers 228. The drawers 228 may be configured to slide out of the panel 210 completely, or the drawers 228 may be configured to have a limited range of sliding motion. For example, the drawers 228 may be configured to slide out of the panel 210 completely so that they may be incorporated into a smaller travel case, as will be described in detail below. Additionally, the drawers 228 may contain one or more trays configured to be removed from the drawers 228. For example, a drawer 228 may contain multiple trays stacked on top of each other such that one tray may be lifted up and out of the drawer 228 for access to another tray below. The interior of each drawer 228 or tray may include a single section for storing a single belt or multiple belts within the section. Alternatively, the interior of each drawer 228 or tray may include a number of sections for storing a single belt or multiple belts within each section. The drawers 228 or trays may be lined internally with a soft or cushioning material, such as a felt, a foam, or other similar material, to protect the belts, particularly during transport. Additionally, each of the sections may include a contoured surface having a recess for receiving at least one belt. Such a configuration would prevent movement of the belts during transport. In some aspects, the belts compartment 218 may include hooks, posts, or clasps mounted on one or more surfaces within the belts compartment 218. Such features may be positioned and oriented such that a belt buckle or hole of a belt may be placed onto and retained by a portion of a hook, post, or clasp. In other words, the features may be such that the belt is retained on the hook, post, or clasp, by gravity or by additional retention features, even during transport of the case 100. In other aspects, the belts compartment 218 may include separation panels mounted on one or more surfaces within the belts compartment. In this manner, the separation panels collectively may form separate sections for containing belts. In certain other aspects, the belts compartment 218 may include additional or alternative features for storing, displaying, and protecting various types of belts.

Figure 7:
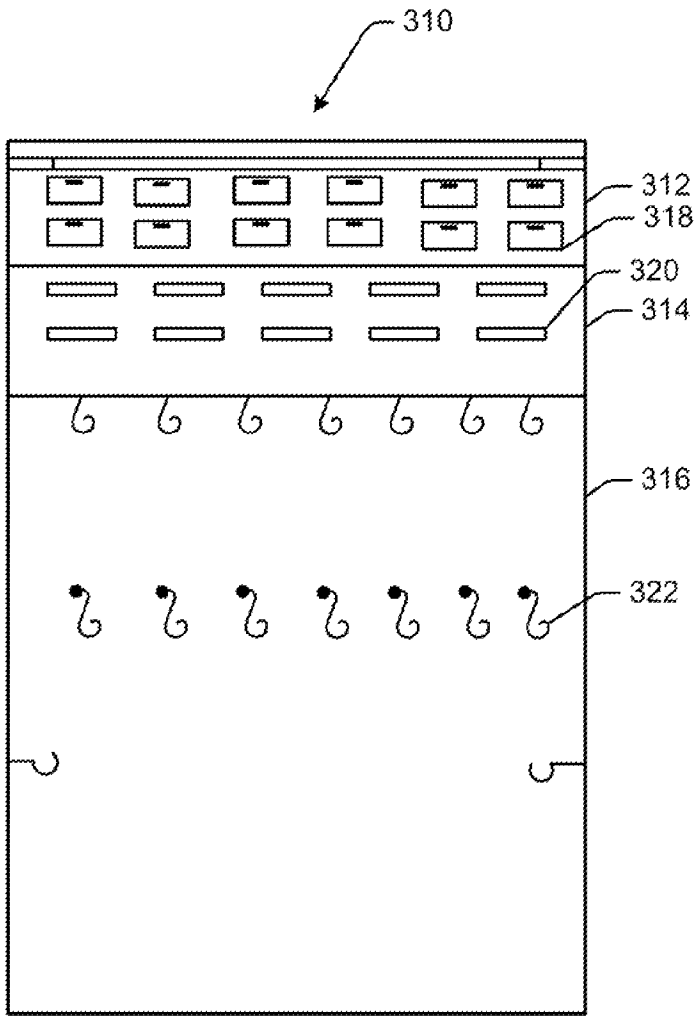
FIG. 7 depicts a front view of a second panel of an example storage and transport case as may be described in the present application.

FIG. 7 shows a second panel 310 of the storage and transport case 100. The second panel may include an earrings compartment 312, a rings compartment 314, and a necklaces compartment 316. The earrings compartment 312 may be able to store and protect various types of earrings. Inner surfaces of the earrings compartment 312 may be lined with a soft or cushioning material to protect the earrings, particularly during transport. In certain aspects, the earrings compartment 312 may include one or more drawers 318 for stud-style earrings or other smaller-sized earrings. The drawers 318 may slide outward from the panel 310, or the drawers 318 may pivot outward from the panel 310 about an edge of the drawers 318. The drawers 318 may be configured to slide out of the panel 310 completely, or the drawers 318 may be configured to have a limited range of sliding motion. For example, the drawers 318 may be configured to slide out of the panel 310 completely so that they may be incorporated into a smaller travel case, as will be described in detail below. Additionally, the drawers 318 may contain one or more trays configured to be removed from the drawers 318. For example, a drawer 318 may contain multiple trays stacked on top of each other such that one tray may be lifted up and out of the drawer 318 for access to another tray below. The interior of each drawer 318 or tray may include a single section for storing a single earring or a single pair of earrings within the section. Alternatively, the interior of each drawer 318 or tray may include a number of sections for storing a single earring or a single pair of earrings within each section. The drawers 318 or trays may be lined internally with a soft or cushioning material to protect the earrings, particularly during transport. For example, the drawers 318 or trays may be lined with a felt, a foam, or other similar material. Additionally, each of the sections may include a pillowed surface having a recess for securely receiving an earring or pair of earrings. Such a configuration would prevent movement of the earrings during transport of the case 100. In some aspects, the earrings compartment 312 may include one or more earring storage beams for hanging-style earrings that include hooks. The storage beams may extend horizontally within the earrings compartment 312, and the hooks of various earrings may be placed over the storage beams such that the earrings hang naturally from the storage beams. Each of the storage beams may extend the entire width of the earrings compartment 312, and each of the storage beams may include dividing elements for keeping adjacent earrings separate from one another. Alternatively, each of the storage beams may be sized to hold a single pair of earrings, and thus several storage beams may be aligned along the width of the earrings compartment. In other aspects, the earrings compartment 312 may include additional or alternative features for storing, displaying, and protecting various types of earrings.

The rings compartment 314 may be able to store, display, and protect various types of rings. Inner surfaces of the rings compartment 314 may be lined with a soft or cushioning material to protect the rings, particularly during transport. In certain aspects, the rings compartment 314 may include one or more drawers. The drawers may slide outward from the panel 310, or the drawers may pivot outward from the panel 310 about an edge of the drawers. The drawers may be configured to slide out of the panel 310 completely, or the drawers may be configured to have a limited range of sliding motion. For example, the drawers may be configured to slide out of the panel 310 completely so that they may be incorporated into a smaller travel case, as will be described in detail below. Additionally, the drawers may contain one or more trays configured to be removed from the drawers. For example, a drawer may contain multiple trays stacked on top of each other such that one tray may be lifted up and out of the drawer for access to another tray below. The interior of each drawer or tray may include a single section for storing a single ring or multiple rings within the section. Alternatively, the interior of each drawer or tray may include a number of sections for storing a single ring or multiple rings within each section. The drawers or trays may be lined internally with a soft or cushioning material, such as a felt, a foam, or other similar material, to protect the rings, particularly during transport. Additionally, each of the sections may include a pillowed surface having a recess for securely receiving at least one ring. Such a configuration would prevent movement of the rings during transport. In other aspects, the rings compartment 314 may include one or more ring storage beams 320 for retaining rings. The storage beams 320 may extend horizontally within the rings compartment 314, and rings may be placed over the storage beams 320 such that the rings hang naturally from the storage beams 320. Each of the storage beams 320 may extend the entire width of the rings compartment 314, and each of the storage beams 320 may include dividing elements for keeping adjacent rings separate from one another. Alternatively, each of the storage beams 320 may be sized to hold a single ring, and thus several storage beams 320 may be aligned along the width of the rings compartment 314. In some aspects, a storage beam 320 may be pivotally connected to one inner surface of the rings compartment 314 at one end and releaseably connected to another inner surface of the rings compartment 314 at the other end. Accordingly, the other end of the storage beam 320 may be pivoted outward to allow a ring to be slid onto the storage beam 320 for secure retention. In certain aspects, the rings compartment 314 may include hooks, posts, or clasps mounted on one or more surfaces within the rings compartment 314. Such features may be positioned and oriented such that a finger hole of a ring may be placed onto and retained by a portion of a hook, post, or clasp. In other words, the features may be such that the ring is retained on the hook, post, or clasp, by gravity or by additional retention features, even during transport of the case 100. In certain other aspects, the rings compartment 314 may include additional or alternative features for storing, displaying, and protecting various types of rings.

The necklaces compartment 316 may be able to store, display, and protect various types of necklaces. Inner surfaces of the necklaces compartment 316 may be lined with a soft or cushioning material to protect the necklaces, particularly during transport. In certain aspects, the necklaces compartment 316 may include one or more drawers. The drawers may slide outward from the panel 310, or the drawers may pivot outward from the panel 310 about an edge of the drawers. The drawers may be configured to slide out of the panel 310 completely, or the drawers may be configured to have a limited range of sliding motion. For example, the drawers may be configured to slide out of the panel 310 completely so that they may be incorporated into a smaller travel case, as will be described in detail below. Additionally, the drawers may contain one or more trays configured to be removed from the drawers. For example, a drawer may contain multiple trays stacked on top of each other such that one tray may be lifted up and out of the drawer for access to another tray below. The interior of each drawer or tray may include a single section for storing a single necklace or multiple necklaces within the section. Alternatively, the interior of each drawer or tray may include a number of sections for storing a single necklace or multiple necklaces within each section. The drawers or trays may be lined internally with a soft or cushioning material, such as a felt, a foam, or other similar material, to protect the necklaces, particularly during transport. Additionally, each of the sections may include a contoured surface having a recess for securely receiving at least one necklace. Such a configuration would prevent movement of the necklaces during transport. In other aspects, the necklaces compartment 316 may include one or more necklace storage beams for retaining certain types of necklaces. The storage beams may extend horizontally within the necklaces compartment 316, and necklaces may be placed over the storage beams such that the necklaces hang naturally from the storage beams. Each of the storage beams may extend the entire width of the necklaces compartment 316, and each of the storage beams may include dividing elements for keeping adjacent necklaces separate from one another. Alternatively, each of the storage beams may be sized to hold a single necklace, and thus several storage beams may be aligned along the width of the necklaces compartment 316. In some aspects, a storage beam may be fixed to inner surfaces of the necklaces compartment 316 at each end, which would allow for necklaces having releasable clasps to be placed over the storage beam and then clasped for secure retention. In other aspects, a storage beam may be pivotally connected to one inner surface of the necklaces compartment 316 at one end and releaseably connected to another inner surface of the necklaces compartment 316 at the other end. Accordingly, the other end of the storage beam may be pivoted outward to allow a non-clasped necklace to be slid onto the storage beam for secure retention. In certain aspects, the necklaces compartment 316 may include hooks, posts, or clasps 322 mounted on one or more surfaces within the necklaces compartment 316. Such features may be positioned and oriented such that the necklace may be placed onto and retained by a portion of a hook, post, or clasp 322. In other words, the features may be such that the necklace is retained on the hook, post, or clasp 322 by gravity or by additional retention features, even during transport of the case 100. In some embodiments, the necklaces compartment 316 may include one or more rotating carousels mounted to a top inner surface of the necklaces compartment 316. The rotating carousel may include a number of hooks, posts, or clasps positioned about a circumference of the rotating carousel. Accordingly, each of the hooks, posts, or clasps may retain a necklace, and the carousel may be rotated to bring the different necklaces into view. The rotating carousel may include a locking mechanism to prevent rotation, particularly during transport of the case 100. In some aspects, where the necklaces compartment 316 includes hooks, posts, clasps, or a rotating carousel, the necklaces compartment 316 also may include a tension device for retaining the free ends of necklaces. The tension device may include an elastic strap or band that is able to be placed through the free ends of the necklaces and apply a downward tension on the necklaces. Alternatively, the tension device may include an elastic strap or band that is able to press the free ends of the necklaces against an adjacent surface of the necklaces compartment. In the end, the tension device may protect the necklaces during transport by preventing the necklaces from swinging about and becoming damaged or tangled. In some aspects, the necklaces compartment 316 may include a protective barrier along the front of the necklaces compartment 316 to further protect the necklaces during transport of the case 100. The protective barrier may include a door or panel that may be pivotally opened or removed, particularly when the case 100 is in the display configuration. The protective barrier may be formed of a transparent glass, plastic, or other material such that the necklaces may be viewed even when the barrier is in place. The protective barrier may be lined internally with a soft or cushioning material, such as a felt, a foam, or other similar material, to protect the necklaces. In certain other aspects, the necklaces compartment 316 may include additional or alternative features for storing, displaying, and protecting various types of necklaces.

Figure 8:
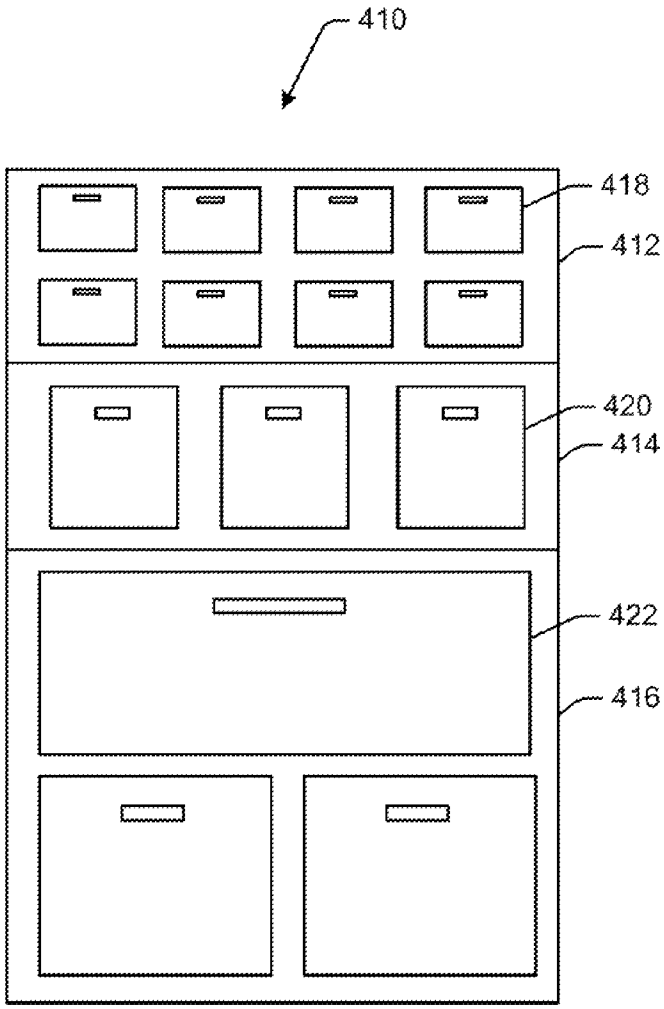
FIG. 8 depicts a front view of a third panel of an example storage and transport case as may be described in the present application.

FIG. 8 shows a third panel 410 of the storage and transport case 100. The third panel may include a sunglasses compartment 412, a hair accessories compartment 414, and a hats compartment 416. The sunglasses compartment 412 may be able to store and protect various types of sunglasses. Inner surfaces of the sunglasses compartment 412 may be lined with a soft or cushioning material to protect the sunglasses, particularly during transport. In certain aspects, the sunglasses compartment 412 may include one or more drawers 418. The drawers 418 may slide outward from the panel 410, or the drawers 418 may pivot outward from the panel 410 about an edge of the drawers 418. The drawers 418 may be configured to slide out of the panel 410 completely, or the drawers 418 may be configured to have a limited range of sliding motion. For example, the drawers 418 may be configured to slide out of the panel 410 completely so that they may be incorporated into a smaller travel case, as will be described in detail below. Additionally, the drawers 418 may contain one or more trays configured to be removed from the drawers 418. For example, a drawer 418 may contain multiple trays stacked on top of each other such that one tray may be lifted up and out of the drawer 418 for access to another tray below. The interior of each drawer 418 or tray may include a single section for storing a single pair of sunglasses or multiple pairs of sunglasses within the section. Alternatively, the interior of each drawer 418 or tray may include a number of sections for storing a single pair of sunglasses or multiple pairs of sunglasses within each section. The drawers 418 or trays may be lined internally with a soft or cushioning material, such as a felt, a foam, or other similar material, to protect the sunglasses, particularly during transport. Additionally, each of the sections may include a contoured surface having a recess for securely receiving at least one pair of sunglasses. Such a configuration would prevent movement of the sunglasses during transport. In some aspects, the sunglasses compartment 412 may include hooks, posts, or clasps mounted on one or more surfaces within the sunglasses compartment 412. Such features may be positioned and oriented such that a pair of sunglasses may be placed onto and retained by a portion of a hook, post, or clasp. In other words, the features may be such that the pair of sunglasses is retained on the hook, post, or clasp, by gravity or by additional retention features, even during transport of the case 100. In certain other aspects, the sunglasses compartment 412 may include additional or alternative features for storing, displaying, and protecting various types of sunglasses.

The hair accessories compartment 414 may be able to store and protect various types of hair accessories. Inner surfaces of the hair accessories compartment 414 may be lined with a soft or cushioning material to protect the hair accessories, particularly during transport. In certain aspects, the hair accessories compartment 414 may include one or more drawers 420. The drawers 420 may slide outward from the panel 410, or the drawers 420 may pivot outward from the panel 410 about a bottom edge of the drawers 420. The drawers 420 may be configured to slide out of the panel 410 completely, or the drawers 420 may be configured to have a limited range of sliding motion. For example, the drawers 420 may be configured to slide out of the panel 410 completely so that they may be incorporated into a smaller travel case, as will be described in detail below. Additionally, the drawers 420 may contain one or more trays configured to be removed from the drawers 420. For example, a drawer 420 may contain multiple trays stacked on top of each other such that one tray may be lifted up and out of the drawer 420 for access to another tray below. The interior of each drawer 420 or tray may include a single section for storing a single hair accessory or multiple hair accessories within the section. Alternatively, the interior of each drawer 420 or tray may include a number of sections for storing a single hair accessory or multiple hair accessories within each section. The drawers 420 or trays may be lined internally with a soft or cushioning material, such as a felt, a foam, or other similar material, to protect the hair accessories, particularly during transport. Additionally, each of the sections may include a contoured surface having a recess for securely receiving at least one hair accessory. Such a configuration would prevent movement of the hair accessories during transport. In some aspects, the hair accessories compartment 414 may include hooks, posts, or clasps mounted on one or more surfaces within the hair accessories compartment 414. Such features may be positioned and oriented such that a hair accessory may be placed onto and retained by a portion of a hook, post, or clasp. In other words, the features may be such that the hair accessory is retained on the hook, post, or clasp, by gravity or by additional retention features, even during transport of the case 100. In certain other aspects, the hair accessories compartment 414 may include additional or alternative features for storing, displaying, and protecting various types of sunglasses.

The hats compartment 416 may be able to store and protect various types of hats. Inner surfaces of the hats compartment 416 may be lined with a soft or cushioning material to protect the hats, particularly during transport. In certain aspects, the hats compartment 416 may include one or more drawers 422. The drawers 422 may slide outward from the panel 410, or the drawers 422 may pivot outward from the panel 410 about an edge of the drawers 422. The drawers 422 may be configured to slide out of the panel 410 completely, or the drawers 422 may be configured to have a limited range of sliding motion. Additionally, the drawers 422 may contain one or more trays configured to be removed from the drawers 422. For example, a drawer 422 may contain multiple trays stacked on top of each other such that one tray may be lifted up and out of the drawer 422 for access to another tray below. The interior of each drawer 422 or tray may include a single section for storing a single hat or multiple hats within the section. Alternatively, the interior of each drawer 422 or tray may include a number of sections for storing a single hat or multiple hats within each section. The drawers 422 or trays may be lined internally with a soft or cushioning material, such as a felt, a foam, or other similar material, to protect the hats, particularly during transport. Additionally, each of the sections may include a contoured surface having a recess for securely receiving at least one hat. Such a configuration would prevent movement of the hats during transport. In some aspects, the hats compartment 416 may include hooks, posts, or clasps mounted on one or more surfaces within the hats compartment 416. Such features may be positioned and oriented such that a hat may be placed onto and retained by a portion of a hook, post, or clasp. In other words, the features may be such that the hat is retained on the hook, post, or clasp, by gravity or by additional retention features, even during transport of the case 100. In certain other aspects, the hats compartment 416 may include additional or alternative features for storing, displaying, and protecting various types of hats.

Figure 9:
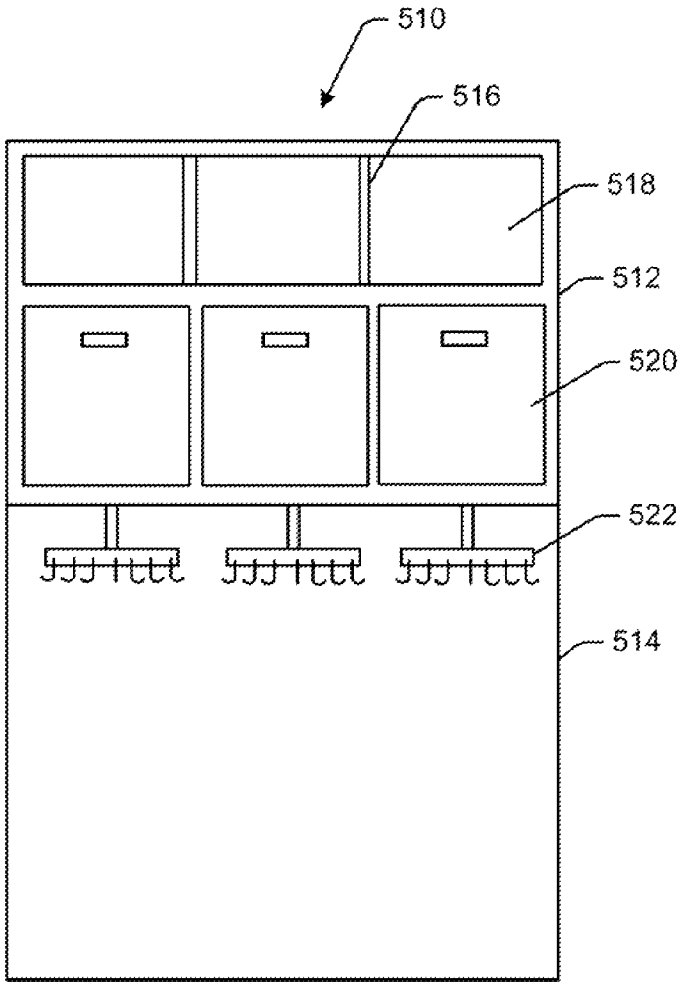
FIG. 9 depicts a front view of a fourth panel of an example storage and transport case as may be described in the present application.

FIG. 9 shows a fourth panel 510 of the storage and transport case 100. The fourth panel 510 may include a handbags compartment 512 and a necklaces compartment 514. The handbags compartment 512 may be able to store and protect various types of handbags or clutches. Inner surfaces of the handbags compartment 512 may be lined with a soft or cushioning material to protect the handbags or clutches, particularly during transport. In certain aspects, the handbags compartment 512 may include vertical and/or horizontal dividers 516 defining separate spaces 518 for handbags or clutches. Inner surfaces of the separate spaces 518 may be lined with a soft or cushioning material to protect the handbags or clutches, particularly during transport. The separate spaces 518 may have varying sizes, such as larger spaces for full-size handbags and smaller spaces for clutches. In some aspects, the handbags compartment 512 may include one or more drawers 520. The drawers 520 may slide outward from the panel 510, or the drawers 520 may pivot outward from the panel 510 about an edge of the drawers 520. The drawers 520 may be configured to slide out of the panel 510 completely, or the drawers 520 may be configured to have a limited range of sliding motion. For example, the drawers 520 may be configured to slide out of the panel 510 completely so that they may be incorporated into a smaller travel case, as will be described in detail below. Additionally, the drawers 520 may contain one or more trays configured to be removed from the drawers 520. For example, a drawer 520 may contain multiple trays stacked on top of each other such that one tray may be lifted up and out of the drawer 520 for access to another tray below. The interior of each drawer 520 or tray may include a single section for storing a single handbag or clutch or multiple handbags or clutches within the section. Alternatively, the interior of each drawer 520 or tray may include a number of sections for storing a single handbag or clutch or multiple handbags or clutches within each section. The drawers 520 or trays may be lined internally with a soft or cushioning material, such as a felt, a foam, or other similar material, to protect the handbags and clutches, particularly during transport. Additionally, each of the sections may include a contoured surface having a recess for securely receiving at least one handbag or clutch. Such a configuration would prevent movement of the handbags and clutches during transport.

The necklaces compartment 514 may be able to store, display, and protect various types of necklaces. Inner surfaces of the necklaces compartment 514 may be lined with a soft or cushioning material to protect the rings, particularly during transport. In certain aspects, the necklaces compartment 514 may include one or more drawers. The drawers may slide outward from the panel 510, or the drawers may pivot outward from the panel 510 about an edge of the drawers. The drawers may be configured to slide out of the panel 510 completely, or the drawers may be configured to have a limited range of sliding motion. For example, the drawers may be configured to slide out of the panel 510 completely so that they may be incorporated into a smaller travel case, as will be described in detail below. Additionally, the drawers may contain one or more trays configured to be removed from the drawers. For example, a drawer may contain multiple trays stacked on top of each other such that one tray may be lifted up and out of the drawer for access to another tray below. The interior of each drawer or tray may include a single section for storing a single necklace or multiple necklaces within the section. Alternatively, the interior of each drawer or tray may include a number of sections for storing a single necklace or multiple necklaces within each section. The drawers or trays may be lined internally with a soft or cushioning material, such as a felt, a foam, or other similar material, to protect the necklaces, particularly during transport. Additionally, each of the sections may include a contoured surface having a recess for securely receiving at least one necklace. Such a configuration would prevent movement of the necklaces during transport. In other aspects, the necklaces compartment 514 may include one or more necklace storage beams for retaining certain types of necklaces. The storage beams may extend horizontally within the necklaces compartment 514, and necklaces may be placed over the storage beams such that the necklaces hang naturally from the storage beams. Each of the storage beams may extend the entire width of the necklaces compartment 514, and each of the storage beams may include dividing elements for keeping adjacent necklaces separate from one another. Alternatively, each of the storage beams may be sized to hold a single necklace, and thus several storage beams may be aligned along the width of the necklaces compartment 514. In some aspects, a storage beam may be fixed to inner surfaces of the necklaces compartment 514 at each end, which would allow for necklaces having releasable clasps to be placed over the storage beam and then clasped for secure retention. In other aspects, a storage beam may be pivotally connected to one inner surface of the necklaces compartment 514 at one end and releaseably connected to another inner surface of the necklaces compartment 514 at the other end. Accordingly, the other end of the storage beam may be pivoted outward to allow a non-clasped necklace to be slid onto the storage beam for secure retention. In certain aspects, the necklaces compartment 514 may include hooks, posts, or clasps mounted on one or more surfaces within the necklaces compartment 514. Such features may be positioned and oriented such that the necklace may be placed onto and retained by a portion of a hook, post, or clasp. In other words, the features may be such that the necklace is retained on the hook, post, or clasp, by gravity or by additional retention features, even during transport of the case 100. In some embodiments, the necklaces compartment 514 may include one or more rotating carousels 522 mounted to a top inner surface of the necklaces compartment 514. The rotating carousel 522 may include a number of hooks, posts, or clasps positioned about a circumference of the rotating carousel 522. Accordingly, each of the hooks, posts, or clasps may retain a necklace, and the carousel 522 may be rotated to bring the different necklaces into view. The rotating carousel 522 may include a locking mechanism to prevent rotation, particularly during transport of the case 100. In some aspects, where the necklaces compartment 514 includes hooks, posts, clasps, or a rotating carousel, the necklaces compartment 514 also may include a tension device for retaining the free ends of necklaces. The tension device may include an elastic strap or band that is able to be placed through the free ends of the necklaces and apply a downward tension on the necklaces. Alternatively, the tension device may include an elastic strap or band that is able to press the free ends of the necklaces against an adjacent surface of the necklaces compartment. In the end, the tension device may protect the necklaces during transport by preventing the necklaces from swinging about and becoming damaged or tangled. In some aspects, the necklaces compartment 514 may include a protective barrier along the front of the necklaces compartment 514 to further protect the necklaces during transport of the case 100. The protective barrier may include a door or panel that may be pivotally opened or removed, particularly when the case 100 is in the display configuration. The protective barrier may be formed of a transparent glass, plastic, or other material such that the necklaces may be viewed even when the barrier is in place. The protective barrier may be lined internally with a soft or cushioning material, such as a felt, a foam, or other similar material, to protect the necklaces. In certain other aspects, the necklaces compartment 514 may include additional or alternative features for storing, displaying, and protecting various types of necklaces.

Figure 10:
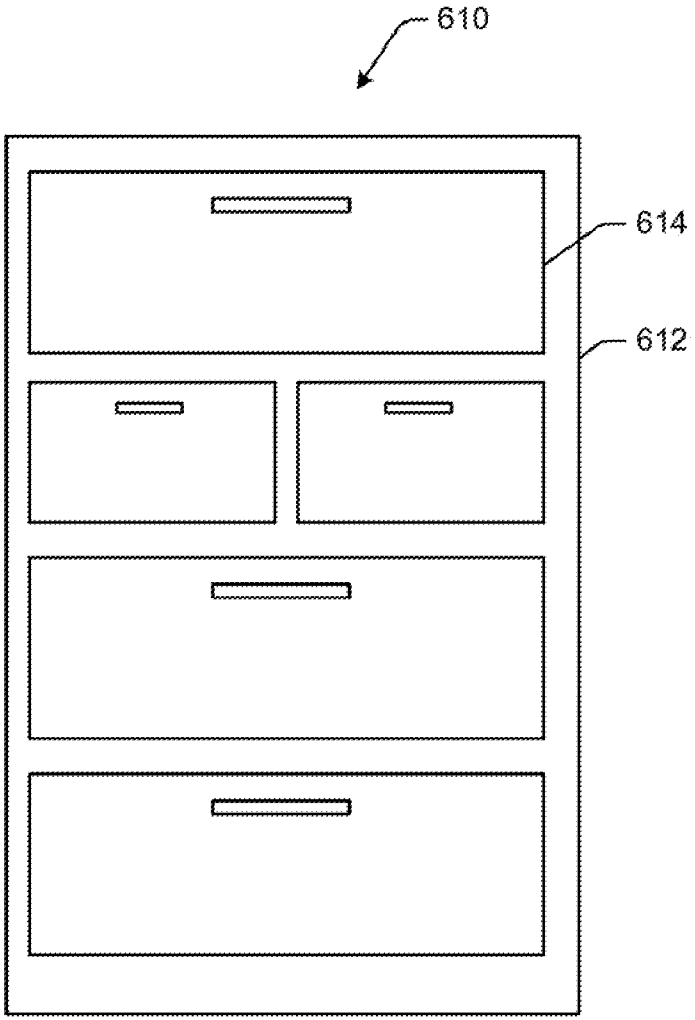
FIG. 10 depicts a front view of a fifth panel of an example storage and transport case as may be described in the present application.

FIG. 10 shows a fifth panel 610 of the storage and transport case 100. The fifth panel 610 may include a scarves compartment 612. The scarves compartment 612 may be able to store and protect various types of scarves. Inner surfaces of the scarves compartment 612 may be lined with a soft or cushioning material to protect the scarves, particularly during transport. In certain aspects, the scarves compartment 612 may include one or more drawers 614. The drawers 614 may slide outward from the panel 610, or the drawers 614 may pivot outward from the panel 610 about an edge of the drawers 614. The drawers 614 may be configured to slide out of the panel 610 completely, or the drawers 614 may be configured to have a limited range of sliding motion. For example, the drawers 614 may be configured to slide out of the panel 610 completely so that they may be incorporated into a smaller travel case, as will be described in detail below. Additionally, the drawers 614 may contain one or more trays configured to be removed from the drawers 614. For example, a drawer 614 may contain multiple trays stacked on top of each other such that one tray may be lifted up and out of the drawer 614 for access to another tray below. The interior of each drawer 614 or tray may include a single section for storing a single scarf or multiple scarves within the section. Alternatively, the interior of each drawer 614 or tray may include a number of sections for storing a single scarf or multiple scarves within each section. The drawers 614 or trays may be lined internally with a soft or cushioning material, such as a felt, a foam, or other similar material, to protect the scarves, particularly during transport. Additionally, each of the sections may include a contoured surface having a recess for receiving at least one scarf Such a configuration would prevent movement of the scarves during transport. In some aspects, the scarves compartment 612 may include vertical and horizontal dividers defining separate spaces for scarves. Inner surfaces of the separate spaces may be lined with a soft or cushioning material to protect the scarves, particularly during transport. The separate spaces may have varying sizes, such as larger spaces for thicker scarves and smaller spaces for thinner scarves. In certain other aspects, the scarves compartment 612 may include additional or alternative features for storing, displaying, and protecting various types of scarves.

Figure 11:
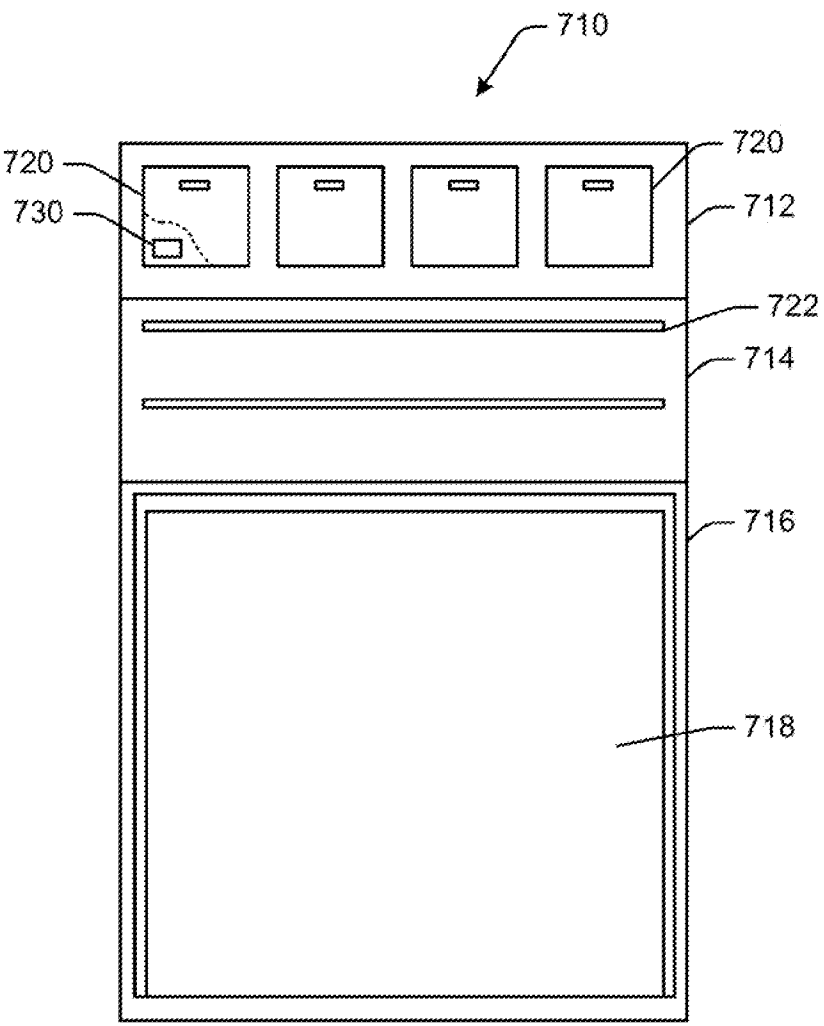
FIG. 11 depicts a front view of a sixth panel of an example storage and transport case as may be described in the present application.

FIG. 11 shows a sixth panel 710 of the storage and transport case 100. The sixth panel 710 may include a watches compartment 712, a bracelets compartment 714, and a travel case compartment 716. The watches compartment 712 may be able to store, display, and protect various types of watches. Inner surfaces of the watches compartment 712 may be lined with a soft or cushioning material to protect the watches, particularly during transport. In certain aspects, the watches compartment 712 may include one or more drawers 720. The drawers 720 may slide outward from the panel 710, or the drawers 720 may pivot outward from the panel 710 about a bottom edge of the drawers 720. The drawers 720 may be configured to slide out of the panel 710 completely, or the drawers 720 may be configured to have a limited range of sliding motion. For example, the drawers 720 may be configured to slide out of the panel 710 completely so that they may be incorporated into a smaller travel case, as will be described in detail below. Additionally, the drawers 720 may contain one or more trays configured to be removed from the drawers 720. For example, a drawer 720 may contain multiple trays stacked on top of each other such that one tray may be lifted up and out of the drawer 720 for access to another tray below. The interior of each drawer 720 or tray may include a single section for storing a single watch or multiple watches within the section. Alternatively, the interior of each drawer 720 or tray may include a number of sections for storing a single watch or multiple watches within each section. The drawers 720 or trays may be lined internally with a soft or cushioning material, such as a felt, a foam, or other similar material, to protect the watches, particularly during transport. Additionally, each of the sections may include a contoured surface having a recess for securely receiving at least one watch. Such a configuration would prevent movement of the watches during transport. In some aspects, the watches compartment 712 may include one or more watch storage beams for retaining certain types of watches. The storage beams may extend horizontally within the watches compartment 712, and watches may be placed over the storage beams such that the watches hang naturally from the storage beams. Each of the storage beams may extend the entire width of the watches compartment 712, and each of the storage beams may include dividing elements for keeping adjacent watches separate from one another. Alternatively, each of the storage beams may be sized to hold a single watch, and thus several storage beams may be aligned along the width of the earrings compartment. In certain aspects, a storage beam may be fixed to inner surfaces of the watches compartment 712 at each end, which would allow for watches having releasable clasps to be placed over the storage beam and then clasped for secure retention. In other aspects, a storage beam may be pivotally connected to one inner surface of the watches compartment 712 at one end and releaseably connected to another inner surface of the watches compartment 712 at the other end. Accordingly, the other end of the storage beam may be pivoted outward to allow a non-clasped watch to be slid onto the storage beam for secure retention. In certain other aspects, the watches compartment 712 may include additional or alternative features for storing, displaying, and protecting various types of watches.

The bracelets compartment 714 may be able to store, display, and protect various types of bracelets Inner surfaces of the bracelets compartment 714 may be lined with a soft or cushioning material to protect the bracelets, particularly during transport. In certain aspects, the bracelets compartment 714 may include one or more bracelet storage beams 722 for retaining certain types of bracelets. The storage beams 722 may extend horizontally within the bracelets compartment 714, and bracelets may be placed over the storage beams 722 such that the bracelets hang naturally from the storage beams 722. Each of the storage beams 722 may extend the entire width of the bracelets compartment 714, and each of the storage beams 722 may include dividing elements for keeping adjacent bracelets separate from one another. Alternatively, each of the storage beams 722 may be sized to hold a single bracelet, and thus several storage beams 722 may be aligned along the width of the earrings compartment. In certain aspects, a storage beam 722 may be fixed to inner surfaces of the bracelets compartment 714 at each end, which would allow for bracelets having releasable clasps to be placed over the storage beam 722 and then clasped for secure retention. In other aspects, a storage beam 722 may be pivotally connected to one inner surface of the bracelets compartment 714 at one end and releaseably connected to another inner surface of the bracelets compartment 714 at the other end. Accordingly, the other end of the storage beam 722 may be pivoted outward to allow a non-clasped or solid bangle-style bracelet to be slid onto the storage beam 722 for secure retention. In some aspects, the bracelets compartment 714 may include one or more drawers. The drawers may slide outward from the panel 710, or the drawers may pivot outward from the panel 710 about an edge of the drawers. The drawers may be configured to slide out of the panel 710 completely, or the drawers may be configured to have a limited range of sliding motion. For example, the drawers may be configured to slide out of the panel 710 completely so that they may be incorporated into a smaller travel case, as will be described in detail below. Additionally, the drawers may contain one or more trays configured to be removed from the drawers. For example, a drawer may contain multiple trays stacked on top of each other such that one tray may be lifted up and out of the drawer for access to another tray below. The interior of each drawer or tray may include a single section for storing a single bracelet or multiple bracelets within the section. Alternatively, the interior of each drawer may include a number of sections for storing a single bracelet or multiple bracelets within each section. The drawers or trays may be lined internally with a soft or cushioning material, such as a felt, a foam, or other similar material, to protect the bracelets, particularly during transport. Additionally, each of the sections may include a contoured surface having a recess for securely receiving at least one bracelet. Such a configuration would prevent movement of the bracelets during transport. In certain other aspects, the bracelets compartment 714 may include additional or alternative features for storing, displaying, and protecting various types of bracelets.

The travel case compartment 716 may be able to store a travel case 718 for separate use from the case 100 in storing and transporting various jewelry items and personal accessories. The travel case 718 may be able to assume a compact configuration and an expanded configuration. Accordingly, when the travel case 718 is not in use separate from the case, the travel case 718 may be received within the travel case compartment 716 in the compact configuration. The travel case 718 may include a casing made of a flexible fabric that is able to fold and compress in order to assume the compact configuration. The travel case 718 also may include a frame including structural members made of a flexible plastic, metal, or composite material. Specifically, the structural members may be flexible yet have shape-memory characteristics such that the structural members may return to their memorized shape when the travel case 718 is not in the compact configuration. The casing of the travel case 718 may define a number of sections for storing various jewelry items and personal accessories. Specifically, each of the number of sections may be able to receive a part of the case 100. For example, some of the number of sections each may be able to receive a removable drawer of the earrings compartment 212, a removable drawer of the rings compartment 214, a removable drawer of the bracelets compartment 216, a removable drawer of the necklaces compartment 316, a removable drawer of the sunglasses compartment 412, a removable drawer of the hair accessories compartment 414, or a removable drawer of the watches compartment 712. Additionally, some of the sections each may be able to receive individual personal accessories, such as a belt, a hat, a scarf, a handbag, or a clutch. Accordingly, the travel case 718 may provide a convenient device for transitioning some of the jewelry and personal accessories from the case 100 for travel purposes when the entire collection of items is not needed. Furthermore, by incorporating some of the storage features of the case 100, such as removable drawers, the jewelry and personal accessories will remain adequately protected during transport.

In some aspects, the storage and transport case 100 may include a Global Positioning System (GPS) tracking device 730 configured to allow for tracking of the precise location of the case 100. The GPS tracking device 730 may be positioned within one of the compartments of one of the panels 110 described above. For example, the GPS tracking device 730 may be positioned within a drawer 720 of the watches compartment 712 of panel 710, as is shown in FIG. 11. It will be understood, however, that the GPS tracking device 730 alternatively may be positioned within other drawers or compartments of the case 100. In some aspects, the GPS tracking device 730 may be positioned within a specialized compartment located within the case 100. The specialized compartment may be located along the bottom of the case 100, such as along the bottom of one of the panels 110. In some aspects, the specialized compartment, and thus the GPS tracking device 730, may be hidden from view such that the presence of the GPS tracking device 730 is not readily apparent upon visual inspection of the case 100. For example, the specialized compartment may be positioned within a wall of one of the panels 110 adjacent one of the drawers. In this manner, the case 100 may be configured such that the specialized compartment may be accessible only upon removal of the adjacent drawer. In some aspects, the case 100 may not include the GPS tracking device 730, but may include the specialized compartment, such that an owner may upgrade the case 100 at a later time to include the GPS tracking device 730 therein.

As noted above, the GPS tracking device 730 may be configured to allow for tracking of the precise location of the storage and transport case 100. The GPS tracking device 730 may be configured to operate in a digital manner known in the relevant art and may be tracked by a third-party service provider. In some aspects, the GPS tracking device 730 may be configured to allow for continuous tracking In other aspects, the GPS tracking device 730 may be configured to allow for tracking only when the case 100 is moving. The GPS tracking device 730 may enter a standby mode when the case 100 is not moving, which may preserve battery life of the GPS tracking device 730. Specifically, the GPS tracking device 730 may include motion sensors that trigger switching from a tracking mode to the standby mode, or from the standby mode to the tracking mode. Preferably, the GPS tracking device 730 may have a battery life of at least two years, although other battery life durations may be possible, particularly if the battery of the GPS tracking device 730 is rechargeable. When the case 100 is moved, the third-party service provider may provide the owner with notification or status updates regarding movement of the case 100. For example, the third-party service provider may send the owner notification or status updates via a phone call, e-mail, or text message. Such notification and status updates may allow the owner to precisely track delivery or arrival of the case 100 when transported by plane, train, boat, car, taxi, or other modes of transportation. Ultimately, the GPS tracking device 730 allows the owner to know the precise location of the case 100 and its contents whenever necessary or desired, depending on the notification criteria established by the owner and the third-party service provider.

Although specific embodiments of the disclosure have been described, one of ordinary skill in the art will recognize that numerous other modifications and alternative embodiments are within the scope of the disclosure. For example, while embodiments of the disclosure have been described with respect to specific configurations and positions, it will be appreciated that numerous configurations and positions are within the scope of this disclosure. Furthermore, although embodiments have been described in language specific to structural elements and features, it will be understood that the disclosure is not necessarily limited to the specific elements or features described. Rather, the specific elements and features are disclosed as illustrative forms of implementing the embodiments.

Conditional language, such as, among others, "can," "could," "might," or "may," unless specifically stated otherwise, or otherwise understood within the context as used, is generally intended to convey that certain embodiments could include, while other embodiments do not include, certain elements or features. Thus, such conditional language is not generally intended to imply that elements or features are in any way required for one or more embodiments.

That which is claimed is:

1. A storage and transport case for jewelry and accessories the case comprising:

a base comprising six vertical panels pivotally connected in series along adjacent vertical edges and movable from a transport configuration to a display configuration; and a top pivotally attached to an upper portion of one of the vertical panels;

wherein each of the vertical panels comprises one or more compartments for storing jewelry or accessories, the one or more compartments accessible along inner surfaces of the vertical panels;

wherein the inner surfaces of the vertical panels are oriented toward one another when the vertical panels are in the transport configuration;

wherein the inner surfaces of the vertical panels are aligned with one another when the vertical panels are in the display configuration;

wherein each of the vertical panels has a trapezoidal shape; and wherein the base has a hexagonal shape when the vertical panels are in the transport configuration.

2. The storage and transport case of claim 1, wherein each of the vertical panels extends from a bottom surface of the base to a top surface of the base.

3. The storage and transport case of claim 2, wherein the vertical panels define an open space therebetween extending from the bottom surface to the top surface when the vertical panels are in the transport configuration and wherein the top removably covers the open space.

4. The storage and transport case of claim 1, wherein the base further comprises one or more fasteners configured to releasably maintain the vertical panels in the transport configuration.

5. The storage and transport case of claim 4, wherein the one or more fasteners comprises one or more magnets mounted about lateral edges of the vertical panels.

6. The storage and transport case of claim 4, wherein the one or more fasteners comprises one or more locks configured to releasably lock the vertical panels in the transport configuration.

7. The storage and transport case of claim 1, wherein the base further comprises one or more wheels mounted to a bottom surface of one or more of the vertical panels.

8. The storage and transport case of claim 7, wherein the one or more wheels are configured to roll in any direction such that the case may roll along a horizontal surface in any direction and wherein the one or more wheels are configured to lock to prevent movement of the case.

9. The storage and transport case of claim 1, wherein the top removably covers a top surface of each of the vertical panels when the vertical panels are in the transport configuration.

10. The storage and transport case of claim 1, wherein the top is configured to pivot from a first position covering a top surface of each of the vertical panels to a second position allowing access to the top surface of each of the vertical panels.

11. The storage and transport case of claim 1, wherein the base further comprises one or more drop-down legs mounted to a bottom surface of one or more of the vertical panels.

12. The storage and transport case of claim 1, wherein the one or more compartments are accessible when the vertical panels are in the display configuration and wherein the one or more compartments are inaccessible when the vertical panels are in the transport configuration.

13. The storage and transport case of claim 12, wherein one of the panels comprises a travel case compartment containing a removable travel case for use separate from the storage and transport case.

14. The storage and transport case of claim 13, wherein the travel case is configured to expand from a compact configuration when disposed within the travel case compartment to an expanded configuration when removed from the travel case compartment.

15. The storage and transport case of claim 13, wherein the travel case comprises a plurality of sections and wherein each of the plurality of sections is configured to removably receive a portion of one of the compartments for storing jewelry and accessories.

16. A storage and transport case for jewelry and accessories the case comprising:

a base comprising three or more vertical panels pivotally connected in series along adjacent vertical edges and movable from a transport configuration to a display configuration; and a top pivotally attached to an upper portion of one of the vertical panels and removably covering a top surface of each of the vertical panels when the vertical panels are in the transport configuration;

wherein each of the vertical panels includes one or more compartments for storing jewelry or accessories, the one or more compartments accessible along inner surfaces of the vertical panels;

wherein the one or more compartments are inaccessible when the vertical panels are in the transport configuration;

wherein the one or more compartments are accessible when the vertical panels are in the display configuration wherein each of the vertical panels has a trapezoidal shape; and wherein the base has a hexagonal shape when the vertical panels are in the transport configuration.

17. A storage case comprising:

a base comprising six vertical panels pivotally connected in series along adjacent vertical edges and movable from a transport configuration to a display configuration;

one or more wheels mounted on a bottom surface of each of the vertical panels; and a top pivotally attached to an upper portion of one of the vertical panels and removably covering a top surface of each of the vertical panels when the vertical panels are in the transport configuration;

wherein each of the vertical panels includes one or more compartments for storing jewelry or accessories, the one or more compartments accessible along inner surfaces of the vertical panels;

wherein the one or more compartments are inaccessible when the vertical panels are in the transport configuration; and wherein the one or more compartments are accessible when the vertical panels are in the display configuration.

18. The storage case of claim 17, wherein each of the vertical panels has a trapezoidal Shape, and wherein the base has a hexagonal shape when the vertical panels are in the transport configuration.

19. The storage case of claim 17, wherein the top is configured to pivot from a first position covering the top surface of each of the vertical panels to a second position allowing access to the top surface of each of the vertical panels.

* * * * *

UNITED STATES PATENT AND TRADEMARK OFFICE

CERTIFICATE OF CORRECTION

PATENT NO. : 9,084,480 B2
APPLICATION NO. : 14/042781
DATED : July 21, 2015
INVENTOR(S) : Erin L. Atwood It is certified that error appears in the above-identified patent and that said Letters Patent is hereby corrected as shown below:

ON THE TITLE PAGE

In the Abstract, Lines 10-12, change "jewelry or accessory such as earrings bracelets belts rings necklaces sunglasses hair accessories hats watches handbags and scarves." to -- jewelry or accessory, such as earrings, bracelets, belts, rings, necklaces, sunglasses, hair accessories, hats, watches, handbags, and scarves. --.

In the Abstract, Lines 13-14, change "the transport configuration and the compartments" to -- the transport configuration, and the compartments --.

IN THE CLAIMS

In Column 20, Lines 14-15 (Claim 1, Lines 1-2), change "jewelry and accessories the case comprising:" to -- jewelry and accessories, the case comprising: --.

In Column 20, Line 41 (Claim 3, Line 4), change "the transport configuration and wherein" to -- the transport configuration, and wherein --.

In Column 20, Line 60 (Claim 8, Line 4), change "direction and wherein" to -- direction, and wherein --.

In Column 21, Line 9 (Claim 12, Line 3), change "the display configuration and wherein" to -- the display configuration, and wherein --.

In Column 21, Line 22 (Claim 15, Line 2), change "a plurality of sections and wherein" to -- a plurality of sections, and wherein --.

In Column 21, Lines 26-27 (Claim 16, Lines 1-2), change "jewelry and accessories the case comprising:" to -- jewelry and accessories, the case comprising: --.

Signed and Sealed this
Twenty-fourth Day of November, 2015

Michelle K. Lee

Michelle K. Lee
*Director of the United States Patent and Trademark Office*

In Column 22, Line 9 (Claim 17, Line 1), change “A storage case comprising:” to -- A storage case, comprising: --.

In Column 22, Line 29 (Claim 18, Line 2), change “a trapezoidal Shape,” to -- a trapezoidal shape, --.